United States Patent [19]

Murray et al.

[11] 4,234,165

[45] Nov. 18, 1980

[54] LUMINAIRE LOWERING DEVICE

[75] Inventors: Omer E. Murray; Richard L. Thompson, both of Hendersonville, N.C.

[73] Assignee: General Electric Company, Schenectady, N.Y.

[21] Appl. No.: 931,081

[22] Filed: Aug. 4, 1978

[51] Int. Cl.[3] ..... B66C 23/60

[52] U.S. Cl. ..... 248/404; 362/403; 248/320; 248/157

[58] Field of Search ..... 254/139, 135 CE, 144, 254/145; 362/35, 431, 391, 430; 187/87, 88; 308/230, 231

[56] References Cited

U.S. PATENT DOCUMENTS

| | | | |
|---|---|---|---|
| 1,928,182 | 9/1933 | Mahoney | 308/230 |
| 3,230,004 | 1/1966 | Lock | 308/230 |
| 3,840,212 | 10/1974 | Latanision | 254/139 |

FOREIGN PATENT DOCUMENTS 340627 10/1919 Fed. Rep. of Germany .... 254/135 CE

*Primary Examiner*—Robert J. Spar
*Assistant Examiner*—Kenneth Noland
*Attorney, Agent, or Firm*—Sidney Greenberg; Lawrence R. Kempton; Philip L. Schlamp

[57] ABSTRACT

Lowering and hoisting apparatus for high mast luminaires. Luminaire support ring is mounted for movement along a hollow pole by a plurality of hoist cables secured at one end to a transition plate which is located inside the pole and to which is also attached a winch cable operated by a winch at the base of the pole for raising and lowering the support ring. Both the hoist cables and the winch cable are secured to the transition plate by freely rotatable ball bearing devices to prevent the cables from twisting and tangling during the raising and lowering operations.

8 Claims, 6 Drawing Figures

Fig. 4.
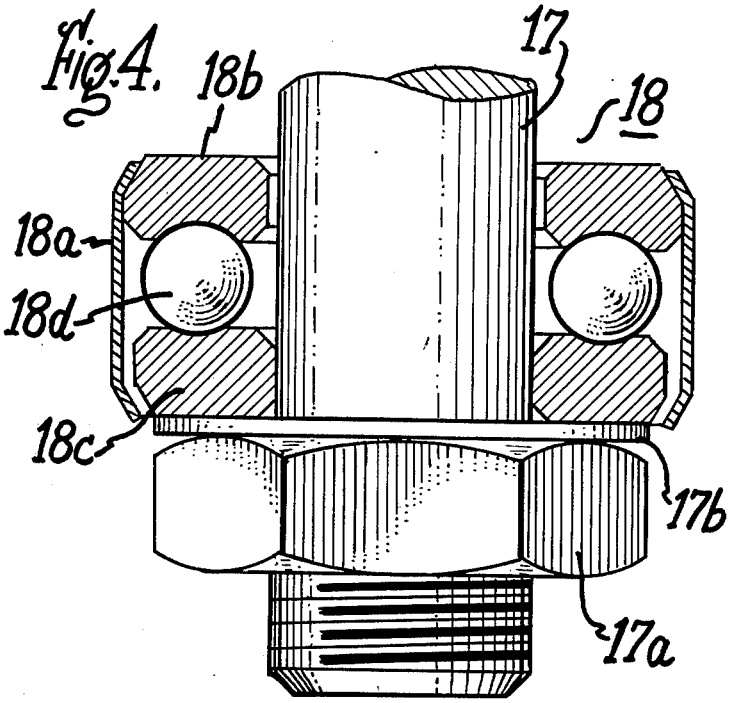
Fig. 5.
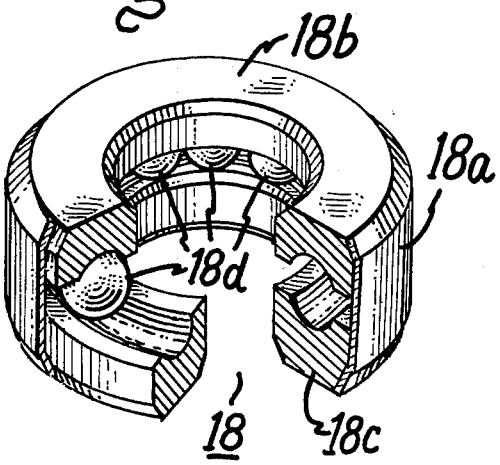
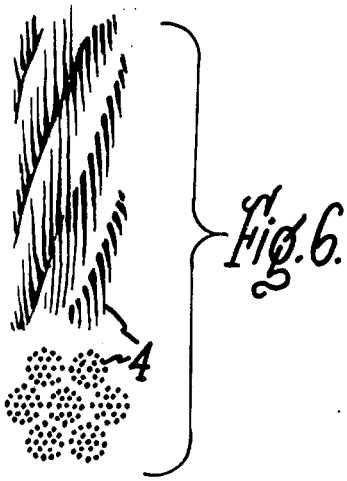
Fig. 6.

LUMINAIRE LOWERING DEVICE

The present invention relates to luminaire hoisting apparatus for raising and lowering a luminaire support on a pole, and more particularly concerns a cable connecting arrangement for such hoisting apparatus.

It is a principal object of the invention to provide an improved cable arrangement for luminaire hoisting apparatus, and particularly to prevent twisting and tangling of the hoisting cables thereof during luminaire raising and lowering operations.

Another object of the invention is to provide an improved cable connecting arrangement of the above type which is simple and economical in construction and is reliable in operation.

Other objects and advantages will become apparent from the following description and the appended claims.

With the above objects in view, the present invention in one of its aspects relates to hoist apparatus comprising, in combination, a hollow pole, cable guide means secured at the top of the pole, load support means movable between the top and bottom of the pole, winch means at the lower end of the pole for raising and lowering the load support means on the pole, a winch cable associated with the winch means and having a free end, a plurality of hoist cables passing around the cable guide means and each connected at one end to the load support means in spaced relation to the other hoist cables, the hoist cables extending at their other ends into the hollow pole, transition plate means arranged in the pole, and a plurality of low friction bearing means respectively securing the other ends of the hoist cables and the free end of the winch cable to the transition plate means, so that the cable ends are individually freely rotatable relative to the transition plate means, whereby twisting and tangling of the hoist and winch cables during raising and lowering of the load support means are avoided.

The invention will be better understood from the following description taken in conjunction with the accompanying drawings, in which:

FIG. 4 is an enlarged detail view in cross-section of a ball bearing such as employed in the transition plate shown in FIG. 3.

FIG. 5 is a perspective view with parts broken away of the ball bearing shown in FIG. 4, and FIG. 6 shows end and side views of a typical cable employed in the hoist apparatus.

Figure 1:
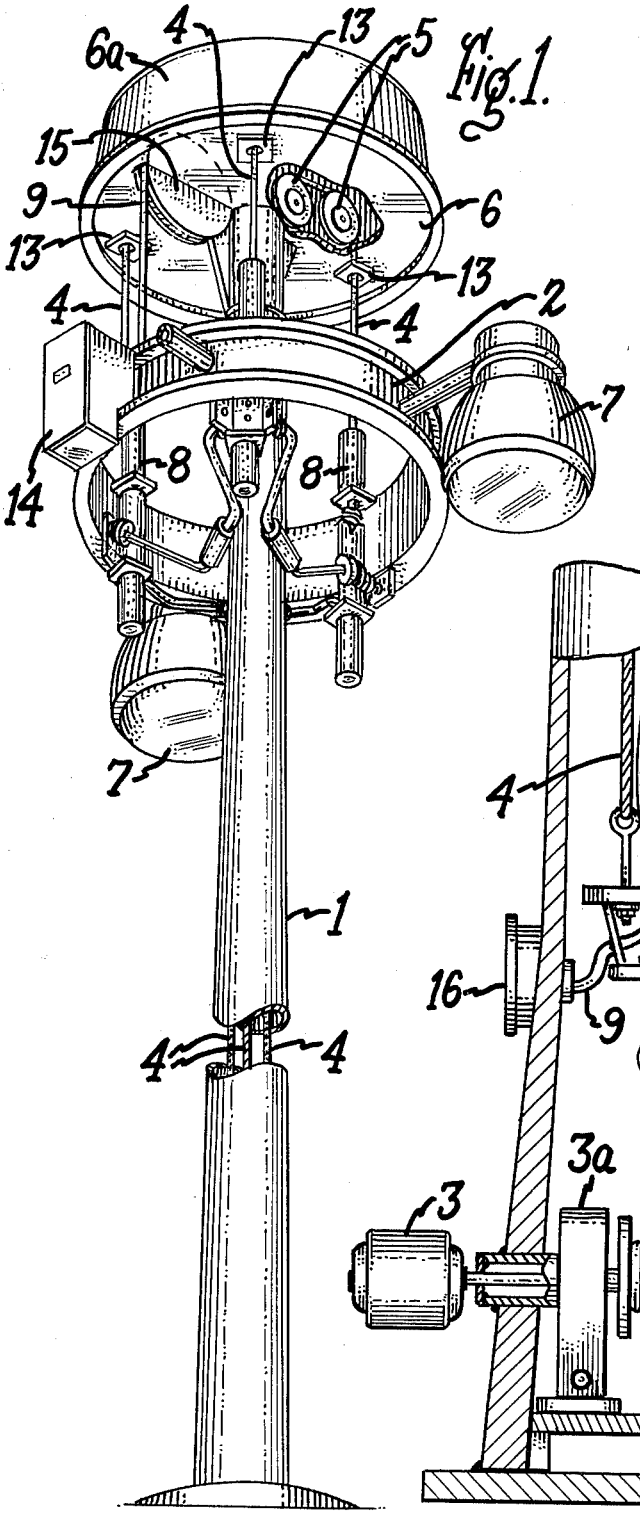
FIG. 1 is a perspective view of a luminaire mounting ring arranged on a pole with hoist means for raising and lowering the mounting ring and which may embody cable connecting means constructed in accordance with the invention.

Referring now to the drawings, and particularly to FIG. 1, there is shown light pole 1 of high-mast type which is of tubular shape tapering somewhat toward its upper end. Mounted on the top of pole 1 is head plate 6 having a dome-shaped cover 6*a*. Surrounding pole 1 is luminaire support ring 2 having secured thereto a number of luminaires 7 uniformly spaced around the support ring. A plurality of hoisting cables 4 (typically three) secured to support ring 2 pass over correspondingly arranged pairs of rotatable guides or sheaves 5 mounted on head plate 6 and extend downwardly through the interior of the pole to winch apparatus 10 (see FIG. 2) at the bottom of the pole driven by motor 3 through gear box 3*a*, the winch being operable for raising and lowering luminaire support ring 2 by winding and unwinding winch cable 11 connected to hoist cables 4 by transition plate 12. Support ring 2 is held in its uppermost (operative) position by a plurality of latches 8 mounted on ring 2 to which hoist cables 4 are respectively attached and which engage latch locking devices 13 correspondingly arranged on head plate 6. The latching apparatus and its operation are more fully disclosed in related co-pending application Ser. No. 826,497 — Thompson, filed Aug. 22, 1977 now U.S. Pat. No. 4,139,884 issued Feb. 13, 1979, and assigned to the same assignee as the present invention.

Power cable 9, connected at one end to wiring box 14 secured to support ring 2 for transmitting current to luminaires 7, passes around power cable sheave 15 and downward through pole 1 and through plate 12 (see FIG. 3) for connection to a power source (not shown) accessible through hand hole 16 near the bottom of the pole, the electrical connection being made by a plug 9*a* at the end of power cable 9 which is readily detachable from the power source.

Figure 2:
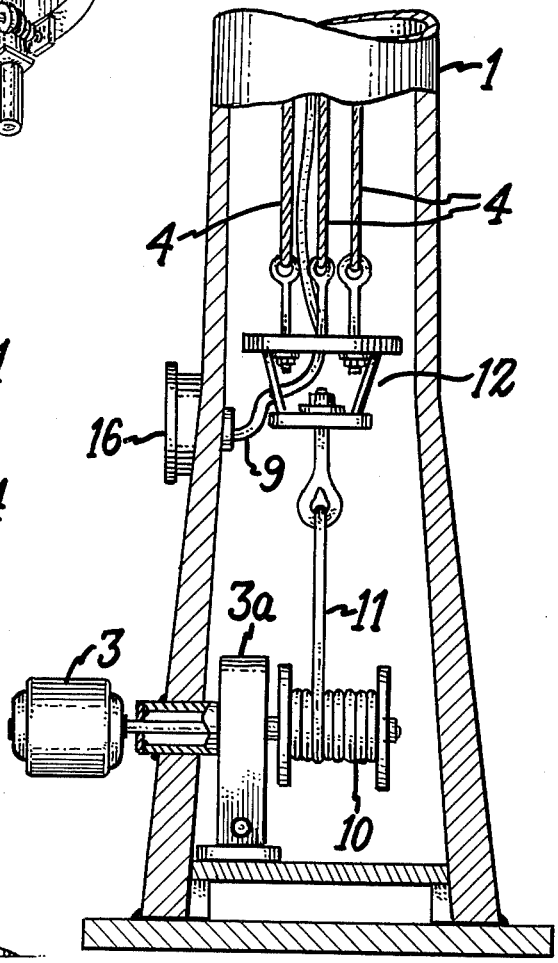
FIG. 2 is an elevational view of the lower portion of the pole, with parts broken away, showing the hoist and winch cables connected to a transition plate, and a winch for moving the cables.

With the luminaire support ring 2 in operating position at the top of pole 1, transition plate 12 is in the lower portion of the pole as shown in FIG. 2. When luminaire ring 2 is to be lowered for servicing of the luminaires, power cable 9 is detached from the power source and winch 10 is operated to unwind winch cable 11, allowing transition plate 12 to rise while luminaire ring 2 descends toward the bottom of the pole.

Hoist cables 4 and winch cable 11 are typically constructed of individual wires spirally wound into strands which in turn are spirally wound into the final cable or wire rope form, as depicted in FIG. 6. When such cables are loaded in tension, they accordingly tend to unwind. As a result, when such cables are employed in known types of lowering apparatus in which a transition plate connects the winch cable to the hoist cables, it has been found that during the luminaire lowering and raising operations torques of differing direction and degree are produced on the winch and hoist cables, causing rotation of the transition plate about a vertical axis and twisting of the hoist cables about each other and the electrical cable. As the transition plate moves near the top under these conditions, the hoist cables must untangle in order to pass around their respective sheaves, resulting in such sudden sharp movements of the cables that damage to the hoist cables and the electrical cable often occurs.

Figure 3:
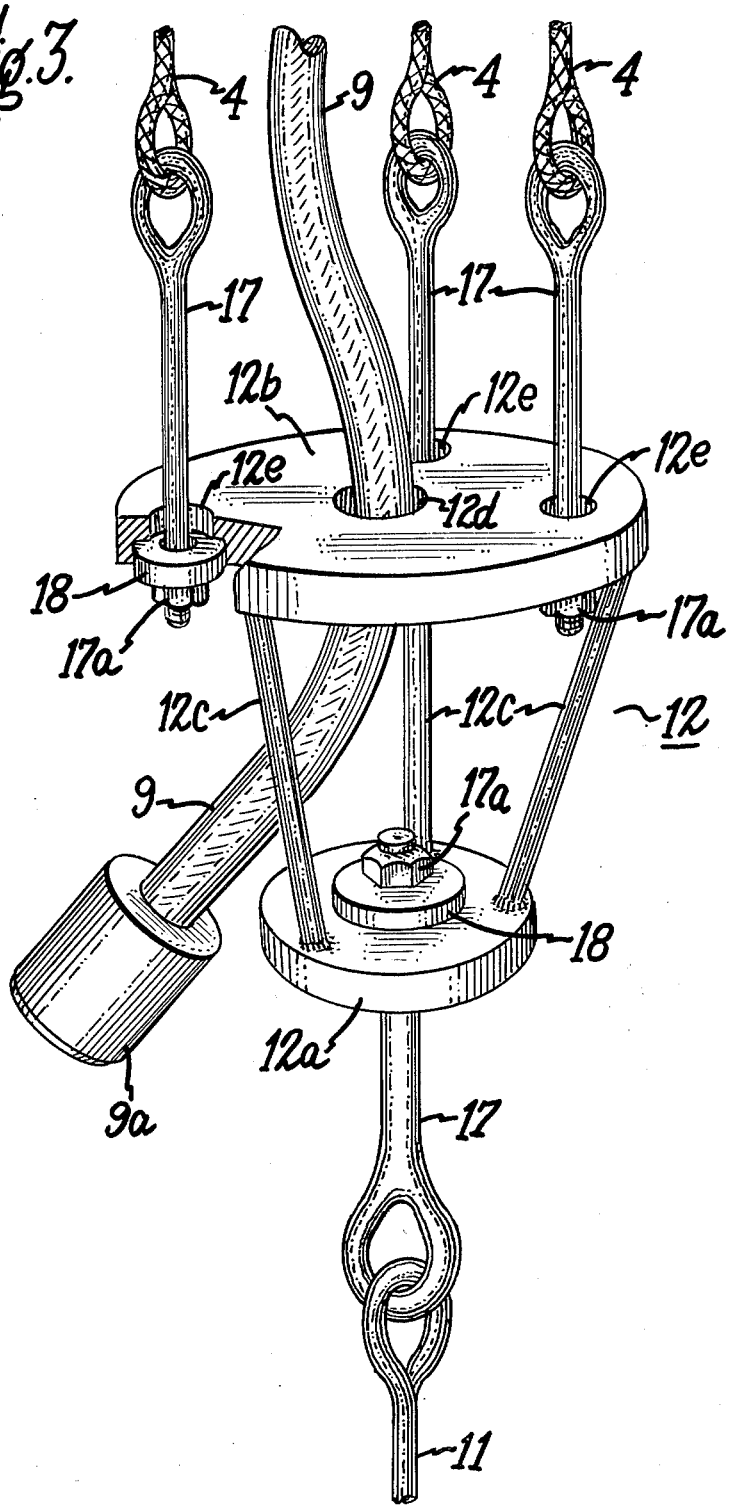
FIG. 3 is a perspective view in enlarged scale of the transition plate to which the hoist and winch cables are connected by low friction bearings in accordance with the invention.

In accordance with the present invention, these disadvantages are overcome by the provision of low friction, freely rotatable connections between all of the hoist and winch cables attached to transition plate 12, as described more fully hereinafter. As seen in FIG. 3, transition plate 12 is formed of lower plate 12*a* and upper plate 12*b* fixedly joined together by struts 12*c*, upper plate 12*b* having a central aperture 12*d* through which electrical cable 9 freely passes. Connection of each hoist cable 4 to upper plate 12 is made by an eyebolt 17 secured at its eye end to an end loop in each cable 4 and at its opposite end to upper plate 12*b* by threaded nut 17*a* engaging the bottom of thrust bearing 18, with the shank of each eye bolt 17 passing freely through apertures 12*e* spaced circumferentially on plate 12*b*. Thrust bearings 18 are preferably ball bearings of conventional type which, as shown in FIGS. 4 and 5, comprise outer housing ring 18*a* surrounding bearing races 18*b*, 18*c* with ball bearings 18*d* between the races 18*b*, 18*c* as shown. As seen best in FIG. 4, bearing race 18*b* is fixed to housing ring 18*a* and the inner and outer diameters of race 18*b* are both somewhat larger than those of race 18*c*, so that in the assembly with eyebolt 17, race 18*b* is spaced from the eyebolt whereas race 18*c* is in contact with the eyebolt but is spaced from housing ring 18*a*, so that during rotation of eyebolt 17, race 18*c* rotates therewith. In the assembly with plate 12*b*, ball bearing 18 is arranged with housing ring 18*a* nonrotatably fixed in the plate and its freely rotatable race 18*c* on the lower side resting on nut 17*a* with intervening washer 17*b*, as shown in FIG. 4. In the connection of winch cable 11 to lower plate 12*a*, the eyebolt and bearing arrangement is inverted, as will be readily understood, and as shown in FIG. 3.

By virtue of the described construction, each of the cables attached to transition plate 12 is individually freely rotatable on the plate, and as a result the loading stresses on the cables do not give rise to the undesirable torques on the transition plate noted above which cause undue rotation of the plate and consequent twisting and tangling of the hoist cables. It has been found that providing a low-friction bearing only at the connection between the winch cable and the transition plate does not avoid the undesirable torque from the hoist cables on the plate, which is often sufficient to twist the hoist cables about the electrical cable and each other.

It will be understood that while a particular form of transition plate is shown and described, other forms of the cable connecting plate may be employed in practicing the invention, as for example, a single plate to which the hoist and winch cables are all attached. Also, while the thrust bearing is preferably of ball bearing type, other low-friction thrust bearings of known type may be employed.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. Hoist apparatus comprising, in combination, a hollow pole, cable guide means secured at the top of said pole, load support means movable between the top and bottom of said pole, winch means at the lower end of said pole for raising and lowering said load support means on said pole, a winch cable associated with said winch means and having a free end, a plurality of hoist cables passing around said cable guide means and each connected at one end to said load support means in spaced relation to the other hoist cables, said hoist cables extending at their other ends into said hollow pole, transition plate means arranged in said pole, and a plurality of freely rotatable thrust bearing means respectively securing said other ends of said hoist cables and said free end of said winch cable to said transition plate means, so that said cable ends are individually freely rotatable relative to said transition plate means, whereby twisting and tangling of said hoist and winch cables during raising and lowering of said load support means are avoided.

2. Apparatus as defined in claim 1, wherein said plurality of thrust bearing means comprise ball bearing means.

3. Apparatus as defined in claim 1, said winch cable and hoist cables being formed of spirally wound wire strands.

4. Apparatus as defined in claim 3, said transition plate means formed with an aperture, and an electrical cable in said pole extending freely through said aperture.

5. Apparatus as defined in claim 4, said transition plate means comprising an upper plate connected to said plurality of hoist cables and a lower plate fixed to said upper plate and connected to said winch cable, said aperture being formed in said upper plate.

6. Apparatus as defined in claim 4, said plurality of thrust bearing means comprising ball bearing means.

7. Apparatus as defined in claim 3, including bolt means connecting said other ends of said hoist cables and said free end of said winch cable to respective ones of said plurality of thrust bearing means.

8. Apparatus as defined in claim 1, said plurality of thrust bearing means connected to said hoist cables being uniformly circumferentially spaced on said transition plate means, the thrust bearing means connecting said winch cable to said transition plate means being arranged centrally on the latter means.

* * * * *